US006001771A

United States Patent [19]

Nakano et al.

[11] Patent Number: 6,001,771

[45] Date of Patent: Dec. 14, 1999

[54] RECEPTOR LAYER TRANSFER SHEET AND CARD-SHAPED PRINTED PRODUCT

[75] Inventors: Yoshinori Nakano; Mikiko Narita; Katsuyuki Oshima, all of Tokyo-to, Japan

[73] Assignee: Dai Nippon Printing Co., Ltd., Tokyo-to, Japan

[21] Appl. No.: 09/079,939

[22] Filed: May 15, 1998

[30] Foreign Application Priority Data

May 16, 1997 [JP] Japan ..... 9-127038

[51] Int. Cl.[6] ..... B41M 5/035; B41M 5/38

[52] U.S. Cl. ..... 503/227; 428/195; 428/412; 428/480; 428/500; 428/522; 428/913; 428/914

[58] Field of Search ..... 8/471; 156/234, 156/235; 428/195, 412, 480, 522, 913, 914; 503/227

[56] References Cited

FOREIGN PATENT DOCUMENTS 0 419 241 A2 3/1991 European Pat. Off. ..... 503/227

*Primary Examiner*—Bruce H. Hess
*Attorney, Agent, or Firm*—Ladas & Parry

[57] ABSTRACT

A receptor layer transfer sheet, as intermediate transfer medium film, provided with a receptor layer to be transferred on a surface of a transfer-receiving material with an image preliminarily formed on the receptor layer comprises: a substrate film; an ionizing radiation (electron beam) hardening resin layer formed on the substrate film to be separable; and a receptor layer formed on the ionizing radiation hardening resin layer. The receptor layer is transferred together with the ionizing radiation hardening resin layer to the transfer-receiving material at a transferring process. A card-shaped printed product can be manufactured by using the receptor layer transfer sheet of the character mentioned above, in which an image is formed, through a sublimation thermal transfer process, on a receptor layer of a receptor layer transfer sheet. The receptor layer is transferred together with the ionizing radiation hardening resin layer on a card-shaped transfer-receiving material through a thermal transfer process.

11 Claims, 1 Drawing Sheet

RECEPTOR LAYER TRANSFER SHEET AND CARD-SHAPED PRINTED PRODUCT

BACKGROUND OF THE INVENTION

The present invention relates to a receptor layer transfer sheet (intermediate transfer medium film) usable for transferring a receptor layer, on which an image has been preliminarily formed, to a surface of a transfer-receiving material and also relates to a card-shaped printed product prepared by using such receptor layer transfer sheet.

There have been known thermal transfer methods as image formation method. In such methods, a thermal transfer sheet, composed of a substrate sheet and a coloring material layer formed on the substrate sheet, and a transfer-receiving material on which a receptor layer is formed as occasion demands, are disposed and pressed between a heating device such as thermal head and a platen roll, and heating portions of the heating device are selectively heated in accordance with information of images to be transferred, so that a coloring material contained in the coloring material layer on the thermal transfer sheet is transferred on the transfer-receiving material thereby to record the images thereon. These thermal transfer methods are generally classified into a fusion thermal transfer method and a sublimation transfer method.

In these thermal transfer methods, the fusion thermal transfer method is a method in which a thermal transfer sheet carrying a heat fusible ink layer is heated by the heating means of the type mentioned above and a softened heat fusible ink is transferred on a transfer-receiving material such as natural fiber paper or plastic sheet thereby to form an image on the transfer-receiving material. The heat fusible ink layer used in this method will be prepared by dispersing a coloring material such as pigment into a binder such as heat fusible wax or resin, and the heat fusible ink layer is carried by a substrate sheet such as plastic film. An image formed by this fusion thermal transfer method has an improved high density and sharpness, and hence, this method is more applicable to the recording of binary images such as letters or lines. Colored or multiple-colored images can be formed by using a thermal transfer sheet provided with heat fusible ink layers of yellow, magenta, cyan, black and the like and recording them on the transfer-receiving material.

On the other hand, the sublimation thermal transfer method is a method in which a thermal transfer sheet carrying a sublimation dye layer is heated by the heating means of the type mentioned above so as to sublimate the sublimation dye contained in the dye layer, and the dye is then transferred on a receptor layer formed on the transfer-receiving material, thus forming an image. The sublimation dye layer used in this method will be prepared by dissolving or dispersing the sublimation dye as coloring material into a binder such as resin, and the sublimation dye layer is carried by a substrate sheet such as plastic film. According to such sublimation thermal transfer method, since transferring amount of the dye can be controlled in dot unit in accordance with energy amount of the heating device such as thermal head, a gradation reproduction due to density modulation can be made possible. Furthermore, since the dye material is used as coloring material, the thus formed image has a transparency, and hence, this method is superior to the reproduction of intermediate colors at a time when a plurality of dye layers of a plurality of colors are transferred in an overlapped manner. For this reason, a full-colored image with high quality can be formed by transferring the sublimation dye of three or four colors of yellow, magenta and cyan, in addition to black, on the transfer-receiving material in an overlapped manner by using the thermal transfer sheet provided with sublimating dye layers of these three or four colors.

In these image forming methods, it is necessary particularly for the sublimation thermal transfer method that the transfer-receiving material on which an image is to be formed is provided with a dyeing property of the dye. Because of this reason, in a case where the surface of the transfer-receiving material has a less dyeing property, it is almost difficult to form an image on the transfer-receiving material as far as the receptor layer is provided thereon.

For example, the Japanese Patent Laid-open Publication No. SHO 62-264994 discloses a technique for providing a receptor layer on a transfer-receiving material having no dyeing property in a manner that a receptor layer transfer sheet formed by providing the receptor layer on a substrate film to be separable is preliminarily prepared and this receptor layer is transferred on the transfer-receiving material. According to this technique, a dye is transferred from a dye layer of a thermal transfer sheet to the receptor layer already transferred on the transfer-receiving material to thereby form an image.

Furthermore, in the Japanese patent Laid-open Publication No. SHO 62-238791, there is disclosed a technique such that a receptor layer transfer sheet formed by providing the receptor layer on a substrate film to be separable is preliminarily prepared and an image is formed by transferring a dye from a thermal transfer sheet on this receptor layer. Thereafter, the receptor layer bearing the image is transferred to the transfer-receiving material by heating the thus formed receptor layer transfer sheet.

Still furthermore, in the Japanese Patent Laid-open Publication HEI 7-156532, there is provided a transfer sheet, on which a receptor layer having an improved image and texture(or feeling) is formed by controlling surface roughness of the receptor layer transfer sheet.

According to these conventional methods or techniques, it becomes possible to transfer and form images on transfer-receiving materials such as a material having a good dyeing property such as card made of polyvinyl chloride, a material having a poor dyeing property or a material, such as polycarbonate resin, easily fusible by the heating of the thermal head.

Still furthermore, in order to obtain an improved durability of images formed by the fusion thermal transfer method or the sublimation thermal transfer method, the Japanese Patent Laid-open Publication No. HEI 3-45391 discloses a technique such that an ionizing radiation hardening resin layer provided with an adhesion layer as an image protection layer is formed on the image through the thermal transfer process to improve the durability of the image.

There have been further provided other methods for improving weather-proof property by forming a ultraviolet shut-off layer by a method similar to that mentioned above.

However, for card-shaped printed products such as ID (identification) cards, it is particularly important to have an improved durability, and many attempts have been made for achieving such purpose. Furthermore, in the conventional protection layer formation methods, the protection layer has been formed by transferring the protection layer on a transfer-receiving material, on which the image had already been transferred and formed, from a protection layer transfer sheet which had been prepared separately. Accordingly, the preparation of the card-shaped printed product having the improved durability by the protection layer has been complicated.

Furthermore, in a case where an image is transferred and formed by the receptor layer transfer sheet on the transfer-receiving material having a poor dyeing property, it has been required to further transfer the protection layer from the protection layer transfer sheet. Accordingly, in such case, the preparation of the card-shaped printed product formed of a material having a poor dyeing property has been also complicated to improve the durability of the image.

SUMMARY OF THE INVENTION

A first object of the present invention is to provide a receptor layer transfer sheet, to solve the problems encountered in the prior art mentioned above, suitable for forming an image with improved durability on a transfer-receiving material.

A second object of the present invention is to provide a card-shaped printed product having an improved durability to solve the problems encountered in the prior art mentioned above.

These and other objects can be achieved according to the present invention by providing, in one aspect, a receptor layer transfer sheet provided with a receptor layer to be transferred on a surface of a transfer-receiving material with an image preliminarily formed on the receptor layer, comprising:

a substrate film;

an ionizing radiation hardening resin layer formed on the substrate film to be separable; and a receptor layer formed on the ionizing radiation hardening resin layer, wherein said receptor layer is transferred together with said ionizing radiation hardening resin layer to the transfer-receiving material at a transferring process.

According to this aspect, the ionizing radiation, such as electron beam, hardening resin layer serving as a protection layer and the receptor layer on which the image is formed, are transferred at the same time on the transfer-receiving material, so that the image having an improved durability can be formed through a single transferring process.

In a preferred embodiments of this aspect, the receptor layer transfer sheet may further comprise an ultraviolet absorption layer which is transferred together with the receptor layer on the transfer-receiving material, and may further comprise an antistatic layer which is transferred together with the receptor layer on the transfer-receiving material.

The receptor layer may be composed of a binder resin and a release agent. It is preferable that the release agent has an amount of 0.5 to 20 weight % with respect to an amount of the binder resin. According to such embodiment, the thermal transfer sheet and the receptor layer transfer sheet are not thermally fused at the image transferring process, so that the image can be clearly transferred on the receptor layer transfer sheet.

The detection mark for positioning the image and identifying a kind of the image may be further disposed on either one side of the receptor layer and the substrate film.

According to the present invention, an ID (identification) card can easily be manufactured by using the receptor layer transfer sheet of the composition mentioned above, and therefore, the image provided with improved durability, light resisting property and weather resisting property can be easily transferred on the card-shaped transfer-receiving material as substrate material for the ID card.

In another aspect of the present invention, there is also provided a card-shaped printed product, which is manufactured by carrying out the steps of:

forming an image, through a sublimation thermal transfer process, on a receptor layer of a receptor layer transfer sheet comprising a substrate film, an ionizing radiation hardening resin layer formed on the substrate film to be separable, and a receptor layer formed on the ionizing radiation hardening resin layer; and transferring said receptor layer together with said ionizing radiation hardening resin layer on a card-shaped transfer-receiving material through a thermal transfer process.

In a preferred embodiment of this aspect, the card-shaped transfer-receiving material is composed of either one of materials of polyvinyl chloride resin, polycarbonate resin, acrylonitrile-butadiene-styrene copolymer resin, acrylonitrile-styrene copolymer resin, and polyethylene-terephtharate resin.

According to this aspect, the ionizing radiation, such as electron beam, hardening resin layer serving as a protection layer and the receptor layer on which the image is formed, are transferred at the same time on the transfer-receiving material, so that the image having an improved durability can be formed through a single transferring process. Furthermore, the image can be formed on the card-shaped transfer-receiving material formed of a substance having poor dyeing property.

The natures and further characteristic features of the present invention will be made more clear from the following descriptions made with reference to the accompanying drawings.

DESCRIPTION OF THE PREFERRED EMBODIMENTS

Figure 1:
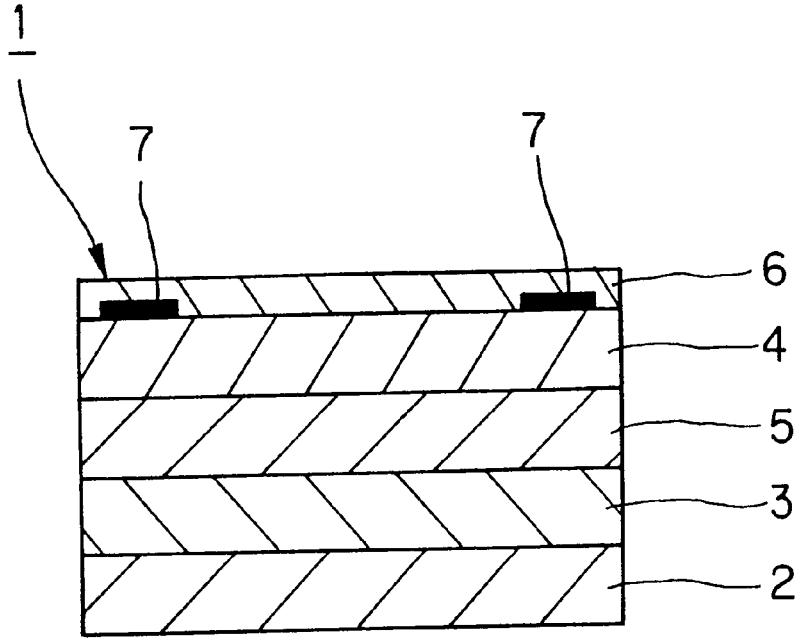
FIG. 1 is a sectional view of one example of a receptor layer transfer sheet as an intermediate transfer medium film according to the present invention.

FIG. 1 shows a sectional view of one example of a receptor layer transfer sheet, which is mentioned hereunder as an intermediate transfer medium film, according to the present invention. Referring to FIG. 1, the intermediate transfer medium film 1 is composed of a substrate film 2, an ionizing radiation hardening resin layer 3 (a resin layer hardenable by irradiation of ionizing radiation, such as electron beam, thus being called as EB resin layer 3 hereinlater) disposed on the substrate film 2 to be separable, an ultraviolet absorption layer 5 disposed on the EB resin layer 3, and a receptor layer 4 disposed on the ultraviolet absorption layer 5. A detection mark 7 and an antistatic layer 6 are further formed on the receptor layer 4. The receptor layer transfer sheet of the present invention is at least composed of the substrate film 2, the EB resin layer 3 and the receptor layer 4 of the above-mentioned materials or layers.

According to the use of such intermediate transfer medium film 1, an image is transferred and formed on a transfer-receiving material by preliminarily forming the image to the receptor layer 4 of the intermediate transfer medium film 1 and then transferring the receptor layer 4 to the transfer-receiving material. The image is formed to the receptor layer 4 of the intermediate transfer medium film 1 through the sublimation thermal transfer method in which a thermal transfer sheet provided with a dye layer is selectively heated by means of a heating device such as thermal head. The receptor layer 4 to which the image is formed and the EB resin layer 3 are thermally transferred at the same time through a single transferring process on transfer-receiving material, for example, a card-shaped transfer-receiving material 8 such as shown in FIG. 2.

Figure 2:
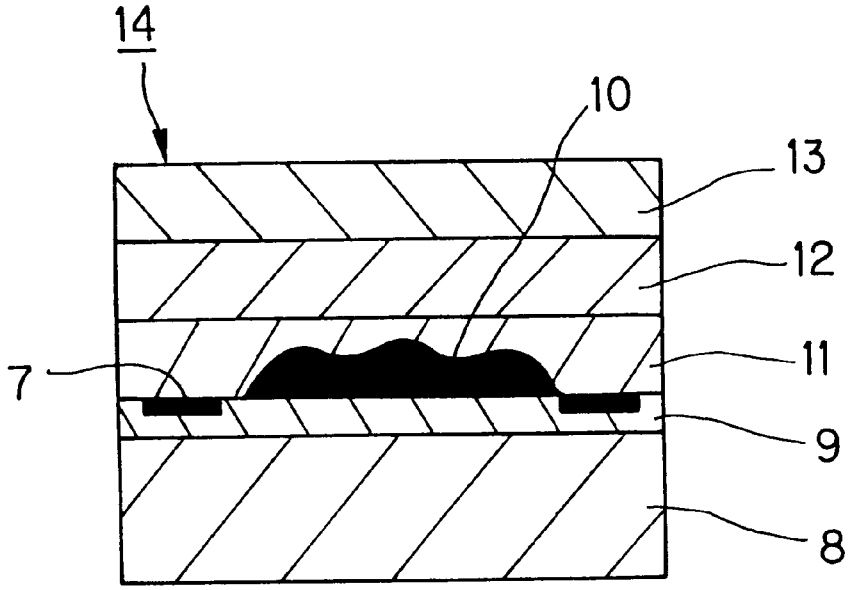
FIG. 2 is a sectional view of one example of a card-shaped printed product according to the present invention formed by using the intermediate transfer medium film.

FIG. 2 is a sectional view of one example of a card-shaped printed product 14 according to the present invention formed from the intermediate transfer medium film 1 of the structure mentioned above.

The card-shaped printed product 14 is composed of the card-shaped transfer-receiving material 8, an antistatic layer 9 formed on the card-shaped transfer-receiving material 8, a receptor layer 11 formed on the antistatic layer 9, an ultraviolet absorption layer 12 formed on the receptor layer 11 and an EB resin layer 13 formed on the ultraviolet absorption layer 12 in a formation order reverse to that of the intermediate transfer medium film 1.

An image 10 transferred on the card-shaped transfer-receiving material 8 is formed by transferring the receptor layer 4 of the intermediate transfer medium film 1, so that the image 10 has a positional arrangement like a mirror image with respect to the image formed on the intermediate transfer medium film 1. Likely, the antistatic layer 9, the receptor layer 11, the ultraviolet absorption layer 12 and the EB resin layer 13 have also positional arrangements reverse to the arrangements of those of the intermediate transfer medium film 1. The image 10 is positioned in the receptor layer 11 on the side of the card-shaped transfer-receiving material 8.

According to the intermediate transfer medium film 1 of the present invention of the structure mentioned above, since the EB resin layer 3 serving as protection layer and the receptor layer 4 on which the image is formed are transferred at the same time on the card-shaped transfer-receiving material 8, an image having an improved durability can be formed on the card-shaped transfer-receiving material 8 through one transferring process. Moreover, according to the present invention, the card-shaped printed product 12 formed with an image having an improved sharpness and durability can be easily obtained by means of the intermediate transfer medium film 1 of the characters mentioned above.

The provision of the EB resin layer 3 can realize the improvement in durability such as light-resisting property or friction-resisting property of the image transferred and formed on the transfer-receiving material. Accordingly, it is desired that the EB resin layer 3 is positioned at the most outside position after the transferring of the image on the card-shaped transfer-receiving material 8, so that the EB resin layer 3 is formed adjacent to the substrate film 2 in the intermediate transfer medium film 1. Further, since the EB resin layer 3 is to be separated from the substrate film 2 of the intermediate transfer medium film 1 and then transferred to the card-shaped transfer-receiving material 8, it may be further better to form a separation layer (releasing layer) between the EB resin layer 3 and the substrate film 2 for easily separating the EB resin layer 3 therefrom.

Furthermore, the image is formed on the receptor layer 4 by transferring or migrate inks or dyes of various colors such as yellow, magenta, cyan and black from the thermal transfer sheet by means of the heating device such as thermal head, so that it is desired that the receptor layer 4 is formed to the most outside position of the intermediate transfer medium film 1. Further, it is preferable that the receptor layer 4 contains a releasing agent for preventing thermal fusion which may be caused at a time of receiving the image from the thermal transfer sheet.

In a case when the intermediate transfer medium film 1 is located at a portion which is liable to be contaminated by dirt or dust, it may be possible to provide the antistatic layer 6 on the receptor layer 4 to prevent the dust or dirt from adhering at the image transferring time and to obtain a clear and sharp image. The antistatic layer 6 may be formed to the rear surface of the substrate film 2 so as to entirely prevent the intermediate transfer medium film 1 from being contaminated and to ensure the stable conveyance of the intermediate transfer medium film 1 in a printer.

The ultraviolet absorption layer 5 is provided for the purpose of protecting the image 10 transferred on the transfer-receiving material 8 from the ultraviolet rays and improving the durability of the image 10. Therefore, it is desired for the ultraviolet absorption layer 5 to be disposed between the EB resin layer 3 as the protection layer and the receptor layer 4 on which the image is received.

The detection mark 7 is utilized in a case where optional images are transferred to transfer-receiving cards, respectively, by performing positional alignment, registration or identification of kinds of images to be transferred at a time of transferring the images to the receptor layer 4. For this purpose, the detection mark or marks 7 may be formed to a position on either one of the receptor layer side of the intermediate transfer medium film 1 or the substrate film side of the intermediate transfer medium film 1, and the shape of the detection mark 7 is not also limited to a specific shape.

As mentioned above, according to the intermediate transfer medium film 1 and the card-shaped printed product 14 formed from such film 1 of the present invention, since at least the receptor layer 4 on which the image is formed and the EB resin layer 3 as the protection layer can be simultaneously transferred to the card-shaped transfer-receiving material 8, the card-shaped printed product can be easily prepared, thus being available.

The respective layers or elements constituting the intermediate transfer medium film 1 and the card-shaped printed product 14 obtained from this film 1 through the transferring process according to the present invention will be described in detail hereunder.

Substrate Film

In the present invention, a substrate film conventionally used for a thermal transfer film can be utilized as it is for the substrate film 2 of the intermediate transfer medium film 1. Furthermore, a substrate film to which a surface treatment for easy adhesion is made will be also utilized for that of the present invention. Thus, there is no specific limitation to the substrate film 2 for the present invention.

As preferred examples of materials of the substrate film 2, there will be listed up the following materials: plastic film made of polyester such as polyethyleneterephtharate, polycarbonate, polyamide, polyimide, cellulose acetate, polyvinylidene chloride, polyvinyl chloride, polystyrene, fluororesin, polypropylene, polyethylene or ionomer; papers such as glassine paper, condenser paper or paraffin paper; cellophane; or composite film formed by the combination of two or more than two kinds of these materials.

The thickness of the substrate film 2 may be changed in accordance with the material to be used so as to provide a suitable strength and heat resisting property, and in usual, the use of the substrate film 2 having the thickness of about 3 to 100 $\mu$m will be preferred.

EB Resin Layer

The ionizing radiation hardening resin layer of the intermediate transfer medium film is formed any one of the ionizing radiation hardening resins, and preferably formed of an ionizing ultraviolet ray (electron beam) hardening resin (called as EB resin, hereinlater).

As preferred examples of the EB resin, there will be adopted the composition containing a polymer or oligomer having a double bond reactive for radical polymerization, a monomer reactive for radical polymerization or a multifunctional monomer and as occasion demands, a light polymerization initiator, and thus capable of being polymerized and crosslinked by the irradiation of electron beam or ultraviolet ray. As the polymer or oligomer having the double bond reactive for radical polymerization, there may be exemplified: unsaturated polyester having a relatively low molecule; polyeter; acrylic resin; epoxy resin; urethane resin; and a compound having a (metha)acrylate moiety such as polyester acrylate or urethane acrylate. These known EB resins can be utilized for the present invention with no specific limitation.

As the monomer reactive for the radical polymerization, there will be listed up the following materials: ethyl (metha) acrylate, (metha)acrylamide, allyl compound, vinyl eter, vinyl ester, heterocyclic vinyl compound, N-vinyl compound, styrene, (metha)acrylic acid, crotonic acid, or itaconic acid. There will be also listed up the following materials as the multifunctional monomer: diethylene glycol di(metha)acrylate, triethylene glycol (metha)acrylate, tetraethylene glycol (metha)acrylate, trimethylol propan tri (metha)acrylate, pentaerythritol tetra(metha)acrylate, dipentaerythritol hexa(metha)acrylate, tris(β-(metha) acryloyloxyethyl) isocyanurate.

In the present invention, if necessary, it may be possible to prepare an ink with a viscosity adjusted by adding a proper solvent or non-reactive transparent resin to the EB resin of the component mentioned above. In such case, the EB resin layer 3 is formed by applying such ink to the substrate film 2 through a gravure coating, gravure reverse coating or roll coating process and a succeeding drying process. It is preferred for the EB resin layer to have a thickness of about 0.5 to 20 μm.

In order to harden the EB resin layer 3 after the drying, a technique of irradiating an ionizing radiation such as electron beam or ultraviolet ray, which is utilized in a known art, can be utilized for the present invention. For example, in the case of the hardening process by using the electron beam, there is usable an electron beam having 50 to 1000 KeV, preferably 100 to 300 KeV, which is emitted from an electron beam accelerator such as Cockroft-Walton's accelerator, Van de Graaff's accelerator, resonation-transformation-type accelerator, insulating-core-transformer-type, linear accelerator, electro-curtain-type accelerator, dynamitron-type accelerator, or radiofrequency-type accelerator. In the case of using the ultraviolet ray, there is usable an ultraviolet ray which is emitted from a lighting source such as super-high pressure mercury lamp, low pressure mercury lamp, carbon arc, xenon arc or metal halide lamp. Further, it is to be noted that the hardening process by the ionizing radiation such as electron beam may be performed just after the formation of the EB resin layer 3 or after the formation of all the layers.

For the formation of the EB resin layer 3, it is preferable to add, to the EB resin, relatively large amount of particles having high transparency, such as inorganic fine particle of sub-micron to several microns of silica, alumina, calcium carbonate, talc, or clay, or organic particle such as acrylic resin, polyester resin, melamine resin or epoxy resin. Further, it is preferable for the particle having high transparency to be added by an amount of 10 to 200 weight parts with respect to 100 weight parts of the EB resin. In the case of less amount of the addition of such particle, sharpness of an end portion of the transferred EB resin layer may be degraded, and in the case of much amount thereof, a good transparency is not obtainable, thus being not available. Furthermore, it may be possible to further improve a lubricating performance, glossiness, light-proof property, brightness and the like of the various images to be covered by further adding another additive such as wax, lubricant, ultraviolet ray absorber, antioxidant, fluorescent whitening agent or the like to the EB resin layer.

The EB resin layer 3 of the characters mentioned above is formed on the substrate film 2 to be separable. However, some combinations of the materials forming the substrate film 2 and the EB resin layer 3 may provide insufficient separation between these layers at the time of the thermal transferring process. In order to obviate such defect from causing, it is preferred to form a separation layer (releasing layer) on the surface of the substrate film 2 before the formation of the EB resin layer 3 on the substrate film 2. This separation layer may be formed of a separation agent mainly containing wax, silicone wax, silicone resin, fluolide resin, acrylic resin or polyvinyl alcohol by a method similar to that utilized for the formation of the EB resin layer 3 as mentioned above mainly including the applying and drying processes so as to have a thickness of about 1 to 2 μm.

Furthermore, when it is desired to form a mat protection layer on a printed product after the image transfer, the surface of the EB resin layer 3 as the protection layer is formed in shape of mat by using the substrate film 2 having the separation layer into which various particles are contained or using the substrate film 2 having a surface on the separation layer side which is subjected to a mat treatment.

Receptor Layer

The receptor layer 4 for the intermediate transfer medium film 1 of the present invention is composed of at least a binder resin, and as occasion demands, various additives such as releasing agent may be further added. As the binder resin forming the receptor layer 4, it is preferable to use a material, capable of being easily dyed by a sublimation dye and easily forming an image. There may be exemplified as examples of the binder resin: polyolefin resin such as polypropylene; halide resin such as polyvinyl chloride, polyvinylidene chloride; vinyl resin such as polyvinyl acetate or polyacrylate; polyester resin such as polyethyleneterephtharate or polybutyleneterephtharate; polystyrene resin; polyamide resin; copolymer of olefin such as ethylene or propylene and another vinyl monomer; ionomer; cellulose derivative; or a mixture of the substances mentioned above. In these materials, the vinyl resin or polyester resin will be most preferably utilized.

In order to prevent the receptor layer 4 from heat fusing to the thermal transfer sheet, it is preferable to add a release agent to the binder resin, and as the releasing agent, there will be utilized silicone oil, phosphate surface active agent or fluorine compound, among of which the silicone oil is most preferably utilized. It is further preferable for the release agent to have the addition amount of 0.5 to 20 weight % with respect to the amount of the binder resin forming the receptor layer 4. The receptor layer 4 is applied and then dried by substantially the same manner as that performed with respect to the EB resin layer 3, and it is preferred for the receptor layer to have a film thickness, after the drying process, of about 0.1 to 10 $\mu$m.

Ultraviolet Absorption Layer

The ultraviolet absorption layer 5 used for the intermediate transfer medium film 1 of the present invention is formed of a known ultraviolet absorber, for example, a reactive ultraviolet absorber prepared by incorporating a double bond structure reactive for addition polymerization such as vinyl radical, acryloyl radical, methacyloyl radical or the like or another reactive radical or moiety such as alcoholic hydroxyl group, amino group, carboxylic group, epoxy group, isocyanate group or the like into a non-reactive organic ultraviolet absorber such as salicylate, benzophenone, benzotriazol, substituted acrylonitrile, nickel chelate or hindered amine. There will be utilized various methods for reacting and fixing such reactive ultraviolet absorbers, for example, through the radical polymerization of a known resin component such as monomer, oligomer or reactive polymer and the above-mentioned reactive ultraviolet absorber.

Further, in a case where the reactive ultraviolet absorber includes a hydroxyl group, amino group, carboxyl group, epoxy group, or isocyanate group, a thermoplastic resin including a radical or moiety which is reactive to these groups is used and, as occasion demands, a catalyst is added or heating is carried out so as to react with and fix the reactive ultraviolet absorber to the thermoplastic resin.

The ultraviolet absorber layer 5 is formed by copolymerizing the above-mentioned reactive ultraviolet absorber and a resin component such as monomer, oligomer or reactive copolymer to form a thermoplastic copolymerized resin having the ultraviolet absorbing property and then placing the thermoplastic copolymerized resin on the EB resin layer 3. In this formation process, any one of the monomer, the oligomer and the reactive copolymer known as the resin component may be used for the copolymerization with the reactive ultraviolet absorber.

It is preferred for the reactive ultraviolet absorber contained in the thermoplastic copolymerized resin to have an amount of 10 to 90 weight %, and more preferably, of 30 to 70 weight %. Further, it is also preferred for the copolymerized resin to have molecular amount of about 5000 to 250000, and more preferably, of 9000 to 30000.

Antistatic Layer

The antistatic layer 6 utilized for the intermediate transfer medium film 1 of the present invention is formed by using a known antistatic agent such as cationic, anionic, amphoteric, or nonionic antistatic agent. For example, there will be used the cationic antistatic agent such as quaternary ammonium salt or polyamine derivative; anionic antistatic agent such as alkylphosphate; or nonionic antistatic agent such as fatty acid ester. Further, a lubricating agent such as organic or inorganic filler may be added to the above antistatic agent.

The antistatic layer 6 is formed by preparing a compound solution by dissolving or dispersing the above-mentioned antistatic agent into a solvent, applying the compound solution by means of a known method such as gravure coating, gravure reverse coating or roll coating and then drying the same so that the thus obtained antistatic layer 6 has a thickness of about 0.001 to 0.1 $\mu$m.

Detection Mark

The detection mark 7 applied to the intermediate transfer medium film 1 of the present invention is generally used for the purpose of positioning an image to be transferred to the receptor layer 4 of the intermediate transfer medium film 1 and/or identifying the kinds or types of the images to be transferred so as to selectively or optionally transfer the images to the respective cards. In order to achieve such purposes, it is required for the detection mark 7 to have a shape capable of being detected by a detector, but the shape thereof is not specifically limited and, for example, linear shape, rectangular shape, round shape, bar-cord type, hole shape or the like may be adopted. The detection mark or marks 7 may be also provided on either side of the receptor layer 4 or substrate film 2.

The detection mark 7 is applied with various colors which are capable of being detected by a general detector, and for example, in a case where a light transmittance-type detector is used, the detection mark 7 will be colored with silver or black color which has high masking property, and in a case where a light reflection-type detector is used, it is preferable for the detection mark to have metallic luster torn having high reflection performance.

The detection mark 7 of the characters mentioned above is formed through a gravure printing, offset printing, drilling working, hot stamping of a transfer foil made by a vapor deposition, or bonding of a vapor deposition film having an adhesive. However, in the present invention, the formation method is not specifically limited.

Card-shaped Transfer-receiving Material

There will be listed up the following materials, as the card-shaped transfer-receiving material 8 of the present invention to be transferred at least the receptor layer 4 with an image are preliminarily formed thereon together with the EB resin layer 3 from the intermediate transfer medium film 1: polyvinylchloride resin, polycarbonate resin, acrylonitrile-butadien-styrene copolymer resin, acrylonitrile-styrene copolymer resin, or polystyrene-terephtharate resin, which are generally used for the materials of usual cards. Further, it is to be noted that since the image is transferred from the intermediate transfer medium film 1 together with the receptor layer 4, it is not significant for the card-shaped transfer-receiving material 7 as to whether it has a dyeing performance or not.

Furthermore, it is to be of course noted that an image provided with an excellent durability by the EB resin layer can be transferred through a single procedure, to a surface of a transfer-receiving material other than the card-shaped transfer-receiving material of the present invention by using the intermediate transfer medium film 1 of the characters mentioned hereinabove. For example, images with improved durability can be easily formed on curved surfaces of stereoscopic transfer-receiving material such as containers, ornaments or the like by using the intermediate transfer medium film 1 according to the present invention.

Further, in a case where it is required to form different images on respective cards of end users, such as formation of face photographs to ID cards, the intermediate transfer medium film 1 of the present invention will be extremely conveniently usable. For example, for cash cards manufactured by banks, personal ID cards manufactured by firms or the like, or credit cards manufactured by credit firm or the like, the images and the protection layers can be transferred on the transfer-receiving materials such as cards through a single operation, whereby the card-shaped printed products with improved durability can be easily produced.

EXAMPLE

Hereunder, the intermediate transfer medium film 1 according to the present invention will be more concretely described by way of a preferred example executed.

An intermediate transfer medium film 1 was prepared by using a polyethyleneterephtharate (PET) film (12F65K manufactured by Toray Co., Ltd.) as substrate film 2 having a thickness of 12 $\mu$m and forming an EB resin layer 3, an ultraviolet absorber layer 5 and a receptor layer 4 in this order.

The EB resin layer 3 was prepared by applying an ink having the following composition at an amount of 5 g/m$^2$ in solid components on the substrate film 2 and then drying the same.

Coating Composition for EB Resin Layer

Dipentaerythritolhexaacrylate :40 weight parts

Hydrophobic colloidal silica :40 weight parts

Polymethyl methacrylate :20 weight parts

Polyethylene wax :3 weight parts

Methyl ethyl ketone/Toluene (weight ratio 1:1) :500 weight parts

The ultraviolet absorber layer 5 was prepared by applying an ink having the following composition at an amount of 1 g/m$^2$ in solid components on the EB resin layer 3 and then drying the same.

Coating Composition for Ultraviolet Absorber Layer

Copolymer resin reacted and bonded with a reactive ultraviolet absorber (UVA-633L, manufactured by BASF Japan) :20 weight parts Methyl ethyl ketone/Toluene (weight ratio 1:1) :80 weight parts In the next step, electron beams were irradiated, by using electron beam irradiator (manufactured by Nisshin High Voltage Co., Ltd.) under condition of 180 KV and 5 Mrad, for hardening the EB resin layer 3.

The receptor layer 4 was prepared by applying an ink having the following composition at an amount of 2 g/m$^2$ in solid component on the ultraviolet absorber layer 5 and then drying the same.

Coating Composition for Receptor Layer

Vinyl chloride-vinyl acetate copolymer (1000ALK, manufactured by Denki Kagaku Kogyo Co., Ltd.) :20 weight parts Epoxy-modified silicone (KP1800-U, manufactured by Shinetsu Kagaku Kogyo Co., Ltd.) :1 weight part Methyl ethyl ketone/Toluene (weight ratio 1:1) :80 weight parts The thermal transferring was carried out with the use of the thus obtained intermediate transfer medium film 1 and a thermal transfer sheet, and subsequently, the receptor layer 4 with the image was transferred together with the EB resin layer 3 and the ultraviolet absorber layer 5 to a card-shaped transfer-receiving material 8, thus producing a card-shaped printed product 12, which provided an improved durability and clear image having an improved sharpness.

According to the intermediate transfer medium film as a receptor layer transfer sheet of the present invention, the receptor layer on which an image is preliminarily formed can be transferred, on the transfer-receiving material, together with at least the ionizing radiation (electron beam) hardening resin layer for improving the durability of the image. Therefore, the image improved in the durability can be easily transferred through one transferring process.

The ultraviolet absorption layer and the antistatic layer may be further formed, which are also transferred together with the other layers mentioned above on the transfer-receiving material, so that the image can be prevented from being deteriorated by the ultraviolet rays and also prevented from adhering with dust or dirt through a charging. Thus, the image having improved clearness and sharpness can be easily formed on the transfer-receiving material after the transferring process.

The heat fusion between a dyeing layer of the thermal transfer sheet and the receptor layer of the intermediate transfer medium film can be prevented by containing the release agent to the receptor layer, thus obtaining the clear image. The location of the detection mark can realize an accurate image at a desired position to be transferred.

According to these characteristic features, the intermediate transfer medium film can be effectively applied for the preparation of an ID card and a card-shaped printed product.

What is claimed is:

1. A receptor layer transfer sheet provided with a receptor layer to be transferred on a surface of a transfer-receiving material with an image preliminarily formed on the receptor layer, comprising:

a substrate film;

an ionizing radiation hardening resin layer formed on the substrate film to be separable; and a receptor layer formed on the ionizing radiation hardening resin layer, wherein said receptor layer is transferred together with said ionizing radiation hardening resin layer to the transfer-receiving material at a transferring process.

2. A receptor layer transfer sheet according to claim 1, further comprising an ultraviolet absorption layer which is transferred together with the receptor layer on the transfer-receiving material.

3. A receptor layer transfer sheet according to claim 1, further comprising an antistatic layer which is transferred together with the receptor layer on the transfer-receiving material.

4. A receptor layer transfer sheet according to claim 1, wherein said receptor layer is composed of a binder resin and a release agent, an amount of the release agent being within 0.5 to 20 weight % with respect to an amount of the binder resin.

5. A receptor layer transfer sheet according to claim 1, further comprising a detection mark for positioning the image and identifying a kind of the image disposed on either one side of the receptor layer and the substrate film.

6. A receptor layer transfer sheet according to claim 1, wherein said ionizing radiation hardening resin layer is an electron beam hardening resin layer.

7. A receptor layer transfer sheet according to claim 1, wherein said electron beam hardening resin layer has a function as a protection layer.

8. A receptor layer transfer sheet according to claim 1, which is usable for manufacturing an identification card.

9. A card-shaped printed product, which is manufactured by carrying out the steps of:

forming an image, through a sublimation thermal transfer process, on a receptor layer of a receptor layer transfer sheet comprising a substrate film, an ionizing radiation hardening resin layer formed on the substrate film to be separable, and a receptor layer formed on the ionizing radiation hardening resin layer; and transferring said receptor layer together with said ionizing radiation hardening resin layer on a card-shaped transfer-receiving material through a thermal transfer process.

10. A card-shaped printed product according to claim 9, wherein said card-shaped transfer-receiving material is composed of either one of materials of polyvinyl chloride resin, polycarbonate resin, acrylonitrile-butadiene-styrene copolymer resin, acrylonitrile-styrene copolymer resin, and polyethyleneterephthalate resin.

11. A card-shaped printed product according to claim 9, said card-shaped printed product is an identification card.

* * * * *